US006646231B2

(12) United States Patent
Hotta et al.

(10) Patent No.: US 6,646,231 B2
(45) Date of Patent: Nov. 11, 2003

(54) CERAMIC HEATER AND ITS MANUFACTURING METHOD, GLOW PLUG AND ION CURRENT DETECTING DEVICE

(75) Inventors: Nobuyuki Hotta, Aichi (JP); Takaya Yoshikawa, Aichi (JP); Manabu Okinaka, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 33 days.

(21) Appl. No.: 10/108,242

(22) Filed: Mar. 28, 2002

(65) Prior Publication Data

US 2002/0175156 A1 Nov. 28, 2002

(30) Foreign Application Priority Data

Apr. 2, 2001 (JP) ..... 2001-103441

(51) Int. Cl.[7] ..... F23Q 7/00

(52) U.S. Cl. ..... 219/270; 123/145 A; 313/141; 313/143

(58) Field of Search ..... 219/270, 544; 361/264, 265, 266; 123/145 A, 145 R, 143 C; 313/118, 141, 142, 143

(56) References Cited

U.S. PATENT DOCUMENTS 5,893,993 A 4/1999 Kurano ..... 219/270
5,922,229 A * 7/1999 Kurano ..... 219/270
6,062,185 A * 5/2000 Chiu et al. ..... 123/145 A
6,144,015 A * 11/2000 Chiu et al. ..... 219/270
6,326,595 B2 * 12/2001 Taniguchi et al. ..... 219/270
6,483,079 B2 * 11/2002 Sato et al. ..... 219/270

FOREIGN PATENT DOCUMENTS

| | | | |
|---|---|---|---|
| EP | 0 834 652 | 4/1998 | |
| JP | 10-089223 | 4/1998 | ..... 17/12 |
| JP | 10-089686 | 4/1998 | |
| JP | 10-089687 | 4/1998 | |
| JP | 10-122114 | 12/1998 | ..... 12/12 |

* cited by examiner

*Primary Examiner*—Teresa Walberg
*Assistant Examiner*—Fadi H. Dahbour
(74) *Attorney, Agent, or Firm*—Morrison & Foerster LLP

(57) ABSTRACT

To provide a ceramic heater which is better in the durability of an ion current detecting electrode portion and which can be manufactured at a low cost. A ceramic heater 1 is provided with: an insulating ceramic substrate 13; a resistance heating element 10 buried in the insulating ceramic substrate; and an ion current detecting electrode portion 14 formed integrally with the resistance heating element in the insulating ceramic substrate and having its own surface portion exposed as an ion current detecting face to the surface of the insulating ceramic substrate. The ion current detecting electrode portion 14 is constructed, at its portion including at least a portion of the ion current detecting face 15, of a conductive ceramic phase which is composed mainly of non-metallic conductive ceramic having a cation component made of a nonmetallic element, such as silicon carbide.

26 Claims, 13 Drawing Sheets

39
39a
36
37
34b
39'
70
10b
13
2
1

CERAMIC HEATER AND ITS MANUFACTURING METHOD, GLOW PLUG AND ION CURRENT DETECTING DEVICE

FIELD OF THE INVENTION

The present invention relates to a ceramic heater employed in a glow plug or the like for preheating a Diesel engine and having an ion detecting electrode, and a method for manufacturing the ceramic heater, and a glow plug using the aforementioned ceramic heater and an ion current detecting device using said glow plug.

RELATED ART

From the view point of environmental protection of recent years, not only a gasoline engine but also a Diesel engine is desired for reducing the exhaust gas discharged from the engine and the noxious substance in the exhaust smoke. Especially the Diesel exhaust particle (DEP) to be discharged as a main cause of an incomplete combustion in the engine is being recently regulated in Japan. In order to satisfy such desire, moreover, there have been made various proposals on the construction of the engine, the improvement in the combustion control, the exhaust gas treatment using a catalyzer and the improvement in the fuel or lubricant.

In some engine combustion control system of recent years, moreover, there is mounted a mechanism for detecting the engine combustion state as control information. The specific parameters to be measured are exemplified by the internal cylinder pressure, the combustion light or the ion current. Especially the detection of the engine combustion state in terms of the ion current is accepted useful because the chemical reaction situation accompanying the combustion can be directly grasped. Thus, there have been proposed a variety of ion current detecting methods. On the gasoline engine, there has been adopted a detection method, in which the ignition interval is utilized to use the spark discharge gap of the spark plug in the ion current generating portion. However, this method cannot be adopted in the Diesel engine because this engine does not employ the spark plug, as known in the art.

On the Diesel engine, on the other hand, there is mounted a glow plug for warming up the engine. Therefore, the ion current detecting method utilizing the glow plug has been disclosed, for example, in (unexamined) Japanese Patent Kokai Publication Nos. JP-10-89223A, 10-89686A, 10-89687A and 10-122114A. The summary of the principle will be described in the following.

Specifically, the glow plug is provided with a resistance heating heater arranged in the combustion chamber. This heater is continuously fed with an electric power to heat till the warm-up of the engine is completed, but is not basically used after the warm-up was ended. Therefore, the glow plug is used as an ion current detecting probe. In order to add the ion detecting function to the glow plug, more specifically, an additional structure is made such that an ion current detecting electrode portion is so mounted on the resistance heating element of the heater that a portion of the electrode surface is exposed to the heater surface. At the time of starting the engine, moreover, the warm-up is performed by connecting the resistance heating element with the heating power source to energize it for the heating action. After the end of the warm-up, on the other hand, the power source and the conduction passage are switched for the ion current so that the ion current may be produced between the inner face of the combustion chamber in the grounded engine block and the ion current detecting electrode portion. In case a waveform reflecting the situation of an incomplete combustion is detected in a signal of the ion current, for example, the connection can be switched again to the heating power source to cause the resistance heating element to heat thereby to assist the combustion.

For example, the glow plug disclosed in Japanese Patent Kokai Publication No. JP-10-89686A employs a ceramic heater in which a resistance heating element made of ceramic is buried in an insulating ceramic substrate. As the materials for the resistance heating element and the ion current detecting electrode portion, there are enumerated conductive inorganic compounds such as molybdenum disilicate ($MoSi_2$), pentamolybdenum trisilicate ($Mo_5Si_3$), molybdenum silicon carbide ($MoxSi_3Cy$), molybdenum boride (MOB), tungsten carbide (WC) and TiN, etc.

SUMMARY OF THE DISCLOSURE

However, the conductive inorganic compound of the above-specified material is relatively satisfactory in the electric characteristics when employed as the resistance heating element, but has the following problems as a material for the ion current detecting electrode portion to contact directly with a hot combustion gas. Specifically, Mo or W or a cation component of those inorganic conductive compounds is defective in that it is easily oxidized in contact with the hot combustion gas, and in that an oxide such as $MoO_3$ or $WO_3$ produced is, because of the trivalence, so volatile that it is seriously exhausted at a high temperature to significantly shorten the lifetime of the ion current detecting electrode portion. Here, Japanese Patent Kokai Publication No. JP-10-89686A has also disclosed a mode in which the exposed surface portion of the ion current detecting electrode portion is coated with a precious metal such as Pt, Ir, Rh, Ru or Pd. However, the precious metal is expensive and is complex in the manufacture steps so that it is not economical. Moreover, the contact with the conductive inorganic compound making the substrate for the coating and the separation or cracking of the precious metal coating portion due to the difference in the linear expansion coefficient are liable to raise problems so that the coating is not preferred from the view point of durability.

It is an object of the present invention, according to one aspect, is to provide a ceramic heater which is better in the durability of an ion current detecting electrode portion and which can be manufactured at a low cost.

It is another object, according to another aspect of the invention, to provide a method for manufacturing the ceramic heater. It is a further object, according to a further aspect of the invention to provide a glow plug and an ion current detecting device employing the ceramic heater, respectively.

Further objects and aspects of the invention will become apparent in the entire disclosure, claims and drawings.

According to a first aspect of the present invention, there is provided a first construction of a ceramic heater comprising:

an insulating ceramic substrate;

a resistance heating element made mainly of conductive ceramic and buried in the insulating ceramic substrate; and an ion current detecting electrode portion made mainly of conductive ceramic and integral with the resistance heating element in the insulating ceramic substrate and having a portion of its own surface exposed as an ion current detecting face to the surface of the insulating ceramic substrate, characterized in that the ion current detecting electrode portion is constructed such that a portion including at least a portion of the ion current detecting face is made of a nonmetallic conductive ceramic having a cation component of at least one nonmetallic element.

According to the aforementioned construction of the ceramic heater, the ion current detecting electrode portion is constructed such that a portion including at least a portion of the ion current detecting face is made of a nonmetallic conductive ceramic having a cation component of a nonmetallic element or elements. The nonmetallic conductive ceramic is superior in oxidation resistance to the metallic conductive ceramic which is generally employed as a material for a ceramic resistance heating element and which has a cation component made of a metallic element(s), and also hardly generates high-temperature volatile oxides. By adopting the nonmetallic conductive ceramic as a material for constructing the ion current detecting face, therefore, it is possible to elongate the lifetime of the ion current detecting electrode portion.

In the aforementioned first construction, the nonmetallic conductive ceramic can be made mainly of one kind or two kinds or more of silicide, carbide, nitride or boride of nonmetallic cation element. As the nonmetallic cation element, there can be adopted metalloid such as silicon (Si), germanium (Ge) or selenium (Se), for example. Such one of the aforementioned silicide, carbide, nitride and boride as has an electric conductivity proper for the ion current detection at the working temperature can be properly employed in the present invention.

Of the aforementioned compounds, moreover, one containing silicon carbide as its main component can be properly in the present invention. This compound has a sufficient oxidation resistance even in the working atmosphere in which the temperature rise up to 1,000 to 1,350° C. is anticipated in contact with a hot combustion gas, and is far less expensive than the precious metal or the like. Moreover, the produced oxide is little volatile silicon dioxide so that the oxidation exhaustion hardly occurs. Therefore, it is possible to rationally realize a ceramic heater which is more excellent in the durability of the ion current detecting electrode portion and which can be manufactured at a low cost.

The ion current detecting electrode portion may be made of the aforementioned nonmetallic conductive ceramic only at the surface layer portion including the ion current detecting face. In case the nonmetallic conductive ceramic having an especially excellent electric conductivity such as silicon carbide is employed, however, the ion current detecting electrode portion can be wholly constructed of the nonmetallic conductive ceramic. Moreover, the entirety including not only the ion current detecting electrode portion but also the resistance heating element can also be constructed of the nonmetallic conductive ceramic.

It is remarkably effective in the view point for protecting the ion current detecting electrode portion against the oxidation exhaustion to construct the portion including at least a portion of the ion current detecting face, of the aforementioned nonmetallic conductive ceramic. In order to improve the heater temperature rising characteristics better, on the other hand, a material different from the nonmetallic conductive ceramic, that is, a metallic conductive ceramic having a cation component made of a metallic element can be adopted for the resistance heating element. Specifically, the resistance heating element is constructed mainly of the first conductive ceramic phase having the cation component made of the metallic element(s), and the ion current detecting electrode portion is constructed of the second conductive ceramic phase made of the nonmetallic conductive ceramic, as constructed mainly of the aforementioned silicon carbide.

Here in this Specification, in case a terminology "main component" (or "as major component" or "mainly") is used on the contained component in a substance being noted, it means the component of the highest weight content in that substance. Moreover, the phrase "two kinds or more components are used as the main component" means that the total of the components has a higher weight content than that of any of the remaining individual components. Here on the components of the substance having a structure of a plurality of phases, the main component on the individual constructing elements or constructing compounds can be specified by the aforementioned definitions by deeming the individual phases as the individual substances. On the entire structure, moreover, the "phase" to become the major component in the structure can be specified by the aforementioned definitions by deeming the individual constructing phases as the individual components. In the present invention, moreover, the individual substances, which are conceptionally specified by using the terminology of the "main component", the "major component" and the "mainly", may contain any kind of by-component so long as the basic actions and effects of the present invention can be achieved.

Moreover, a second construction of a ceramic heater according to a second aspect of the present invention comprises:

an insulating ceramic substrate;

a resistance heating element made mainly of conductive ceramic and buried in the insulating ceramic substrate; and an ion current detecting electrode portion made mainly of conductive ceramic and integral with the resistance heating element in the insulating ceramic substrate and having a portion of its own surface exposed as an ion current detecting face to the surface of the insulating ceramic substrate, characterized in that the resistance heating element is made mainly of a first conductive ceramic phase; and in that the ion current detecting electrode portion is constructed such that a portion including at least a portion of the ion current detecting face is made of a second conductive ceramic phase having a better oxidation resistance than that of the first conductive ceramic phase.

In the aforementioned construction, the ion current detecting electrode portion demanded for the oxidation resistance and the exhaustion resistance at a high temperature is constructed such that a portion including at least a portion of the ion current detecting face is made of a second conductive ceramic phase having a better oxidation resistance than that of the first conductive ceramic phase constructing the resistance heating element mainly. As a result, the durability of the ion current detecting electrode portion can be enhanced without sacrificing the performances or the like of the resistance heating element. For example, the first conductive ceramic phase is constructed of ceramic having better electric characteristics demanded as a resistance heating element than those of the second conductive ceramic phase, such as the conductive ceramic phase which has a high electric conductivity at the heater working temperature or which has a low resistance at the beginning of conduction and an excellent temperature rising performance, for example. Then, it is possible to realize an ideal ceramic heater which has both the excellent heater characteristics and the durability of the ion current detecting electrode portion.

In any of the first and second constructions of the ceramic heater of the present invention, the first conductive ceramic phase constructing the resistance heating element mainly may properly employ as a main component one kind or two kinds or more of molybdenum disilicate ($MoSi_2$), tungsten carbide (WC), tungsten disilicate ($WSi_2$), pentamolybdenum trisilicate ($Mo_5Si_3$) molybdenum silicon carbide ($MoxSi_3Cy$: $5>x\geqq4$, $0<y\leqq1$, $x+y=5$), because these are excellent in an electric conductivity at the heater working temperature (e.g., 1,100 to 1,350° C.) and in quick temperature rising performance. It is desired that the resistance heating element has a content of the first conductive ceramic phase of 50 to 75 mass %. There may occur a case where the aforementioned effects are unable to be sufficiently achieved, if the content is less 50 mass %, and the intergranular phase based on the sintering agent(s) may be insufficiently formed to fail to form a dense resistance heating element if the content is more than 75 mass %.

In the first construction in which the use of the nonmetallic conductive ceramic is essential, on the other hand, the second conductive ceramic phase constructed mainly of silicon carbide can be properly employed in the present invention. In the second construction, on the other hand, the second conductive ceramic phase should not be limited especially to the nonmetallic conductive ceramic, if it is superior in the oxidation resistance to the first conductive ceramic phase, but can be constructed of not only the aforementioned silicon carbide but also one kind or two kinds or more of titanium nitride, zirconium nitride, hafnium nitride, titanium boride, zirconium boride and hafnium boride, as its major component. From the view point of retaining excellent electric conductivity and oxidation resistance, however, silicon carbide can also be most properly used in the present invention.

In order to improve the lifetime of the ion current detecting electrode portion better, it is possible to construct the structure of the surface layer portion of the ion current detecting electrode portion mainly of the second conductive ceramic phase, such that the remainder excepting the grain boundary binding phase can be constructed of the second conductive ceramic phase. In order to retain the electric conductivity better, on the other hand, the ion current detecting electrode portion can also be constructed of the composite conductive ceramic in which the first conductive ceramic phase and the second conductive ceramic phase coexist. In this construction, a portion of the second conductive ceramic phase should be exposed to the ion current detecting face.

According to a further aspect of the invention, the ceramic heater of the present invention thus far described can be rationally manufactured by the following manufacturing method. Specifically, the method is characterized by comprising: preparing a composite shaped body, in which an electrode shaped portion for the ion current detecting electrode portion and a heating element shaped portion for the resistance heating element are buried in a substrate shaped portion for the insulating ceramic substrate; and sintering the composite shaped body. For example, the following method can be adopted, especially in case the portion of the ion current detecting electrode portion containing at least a portion of the ion current detecting face is constructed of the aforementioned second conductive ceramic phase whereas the resistance heating element is constructed of the aforementioned first conductive ceramic phase. The method comprises: forming a portion of the electrode shaped portion for the ion current detecting face, into a second shaped body containing a material for at least the second conductive ceramic phase; forming an integrated shaped body in which the second shaped body and a first shaped body made mainly of a material for the first conductive ceramic phase and including a portion for the heating element shaped portion are integrated; and burying the integrated shaped body in the substrate shaped portion for the insulating ceramic substrate, to form the composite shaped body. In this case, the integrated shaped body is efficiently formed by an insert molding method, by which the second shaped body is arranged as an insert in a mold so that a compound containing a material for the first shaped body may be injected into the mold.

Next, the glow plug according to a further aspect, of the present invention is characterized by comprising: a ceramic heater as described in the present invention; and a housing having a mounting portion formed for holding the ceramic heater and for mounting the ceramic heater in an internal combustion engine so that the ion current detecting face may be positioned in a combustion chamber. Moreover, the ion current detecting device is characterized by comprising: the aforementioned glow plug of the present invention; a heating power source unit for energizing the resistance heating element of the glow plug to heat; an ion generating power source unit for applying an ion generating voltage to the ion current detecting electrode portion through the resistance heating element of the glow plug; a power switching portion for switching to connect one of the heating power source unit and the ion generating power source unit selectively with the glow plug; and an ion current detecting portion for detecting an ion current to flow to the ion current detecting electrode portion.

According to the aforementioned constructions of the glow plug and the ion current detecting device, the adoption of the ceramic heater of the present invention makes it hard to exhaust the ion current detecting electrode portion and to deteriorate its characteristics and possible to detect the ion current highly accurately for a long time. Therefore, the constructions highly contribute to a reduction in the toxious substance (especially, Diesel exhaust particle) in the exhaust gas or exhaust smoke discharged from the Diesel engine. Moreover, the entirety can be inexpensively constructed so that the ion current detecting device contributing to the environmental protection can spread widely.

PREFERRED EMBODIMENTS OF THE INVENTION

An embodiment of the invention will be described with reference to the accompanying drawings.

Figure 1:
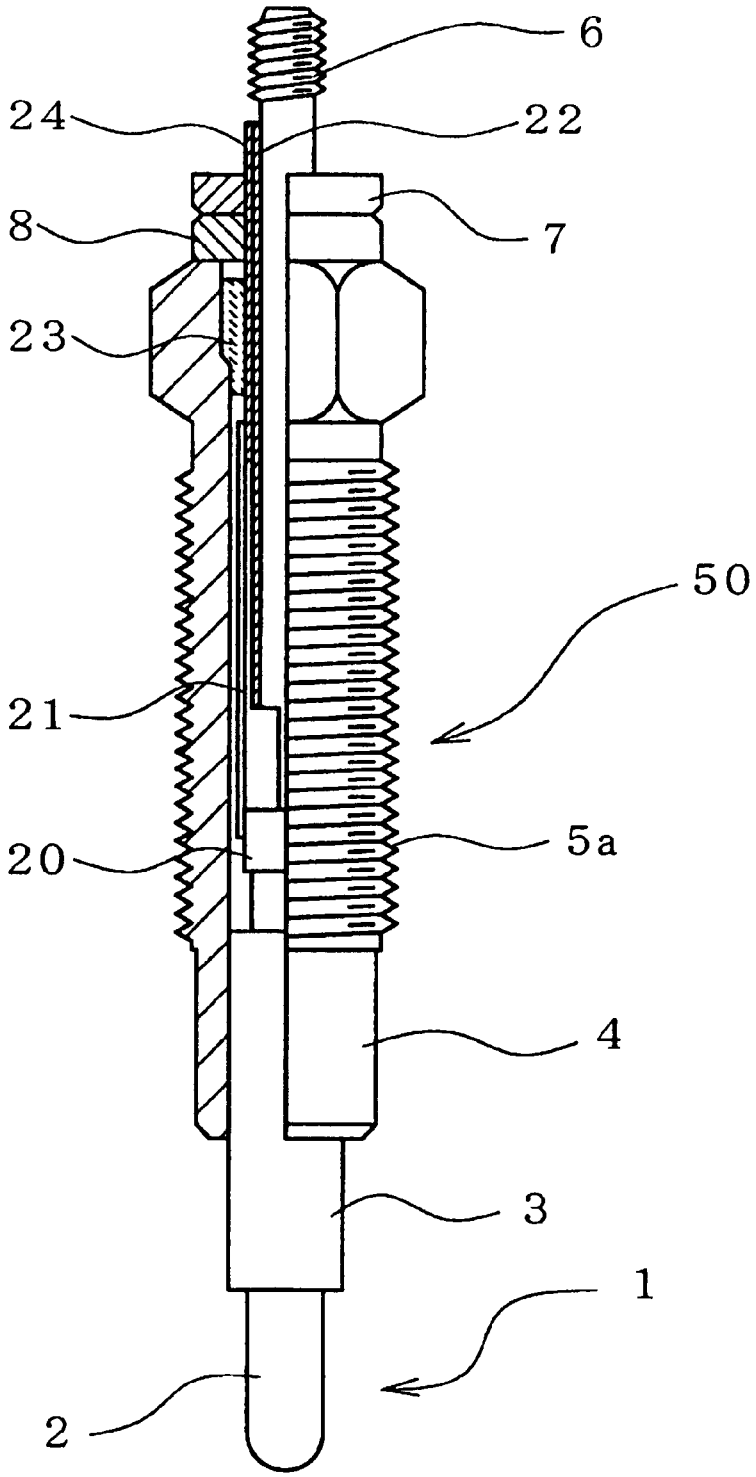
[FIG. 1] A partially sectional front elevation showing one embodiment of a glow plug of the present invention.

FIG. 1 shows a glow plug using a ceramic heater manufactured by a manufacture method of the invention, together with an internal structure of the same. Specifically, the glow plug 50 is provided with: a ceramic heater 1 at its one end side; a metallic outer cylinder 3 covering the outer circumference of the ceramic heater 1 while protruding the leading end portion 2 of the ceramic heater 1; and a cylindrical metallic housing 4 covering the outer side of the outer cylinder 3. The ceramic heater 1 and the outer cylinder 3, and the outer cylinder 3 and the metallic housing 4 are individually jointed to each other by soldering them.

To the trailing end portion of the ceramic heater 1, there is jointed the end portion of a metallic stem 6 which is inserted into the metallic housing 4. The metallic stem 6 is extended at its other end portion to the back side through a seal member 23 which is fitted in the trailing end portion of the metallic housing 4. The metallic stem 6 is fixed with respect to the metallic housing 4 by fitting an additionally fastening packing 7 on the extended portion through an insulating bushing 8. Moreover, the metallic housing 4 is threaded at 5*a* in its outer circumference to form a mounting portion for fixing the glow plug 50 in the not-shown engine block.

Figure 2:
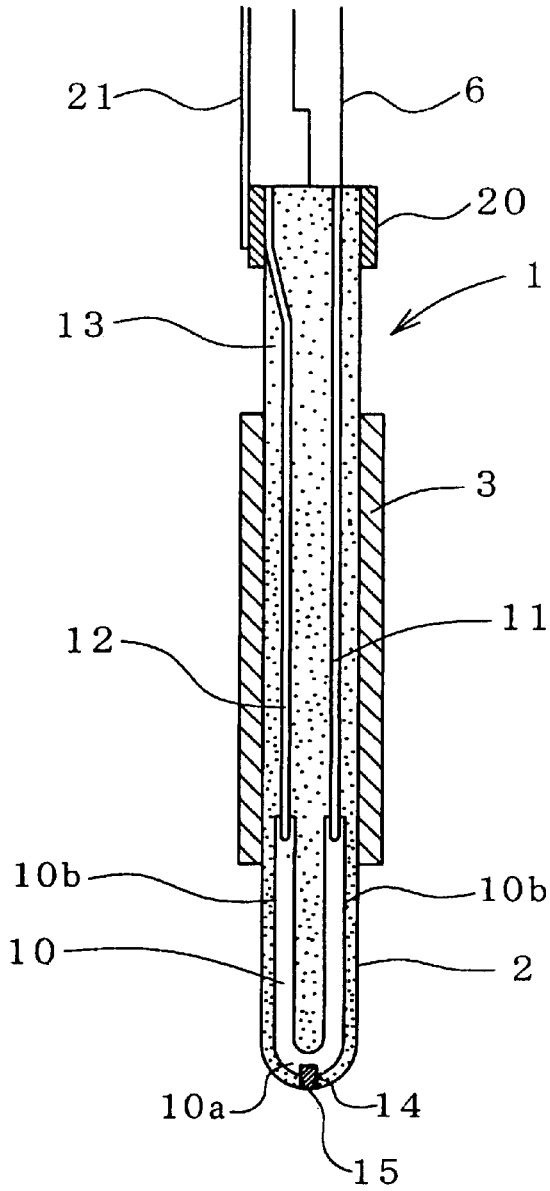
[FIG. 2] A sectional front elevation of a ceramic heater of the glow plug and a perspective view showing the leading end portion of a resistance heating element in an enlarged scale.
Figure 2:
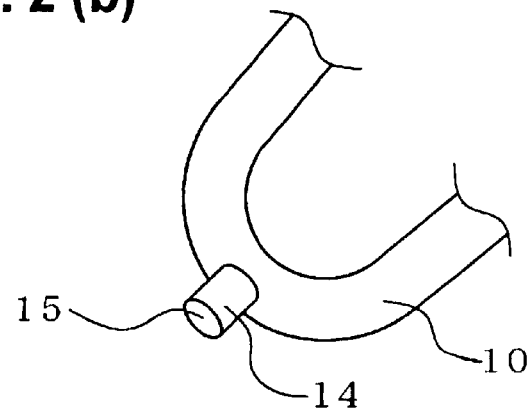
Figure 3:
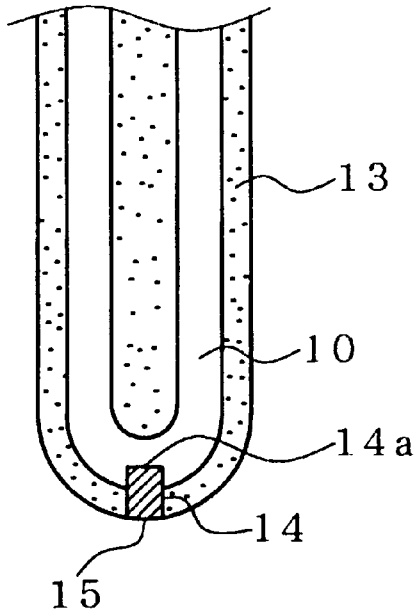
[FIG. 3] A sectional view showing an essential portion of the ceramic heater of FIG. 2 in an enlarged scale.

The ceramic heater 1 is provided with a U-shaped ceramic resistance heating element (as will be simply called the "resistance heating element") 10, as shown in FIG. 2(*a*) or FIG. 3. The leading end portions of linear or rod-shaped metallic lead portions 11 and 12 are buried in the individual two end portions 10*b* and 10*b* of the resistance heating element 10. The resistance heating element 10 and the metallic lead portions 11 and 12 are wholly buried in a rod-shaped insulating ceramic substrate 13 having a circular section. The resistance heating element 10 is so arranged that its leading end portion 10*a* having a U-shaped bottom is positioned on the trailing end side of the ceramic substrate 13. In the insulating ceramic substrate 13, moreover, the resistance heating element 10 is integrated with an ion current detecting electrode portion 14 which is to be exposed as an ion current detecting face 15 at a portion of its own surface to the surface of the insulating ceramic substrate 13.

The insulating ceramic substrate 13 is made of silicon nitride ceramic. The silicon nitride ceramic has a structure in which main phase grains containing silicon nitride ($Si_3N_4$) are bound in an intergranular phase originating from the later-described sintering agent or the like. Here, the main phase is desired to be converted into β-phase of its 90 mass % or more for improving the strength of the substrate. Moreover, the main phase may be made such that Al or O is substituted for a portion of Si or N or such that metallic atoms of Li, Ca, Mg or Y are solid-solved in the phase. For example, there can be exemplified Sialon which is expressed by the following general formula:

β-Sialon: $Si_{6-z}AlzOzN_{8-z}$(z=0 to 4.2);

and

α-Sialon: $Mx(Si, Al)_{12}(O, N)_{16}$(x=0 to 2),

M: Li, Mg, Ca, Y, R (R is a rare earth element excepting La, Ce)

The silicon nitride ceramic can contain at least one kind, which is selected from the individual element groups of 3A, 4A, 5A, 3B (e.g., Al) and 4B (e.g., Si) of the periodic table (IUPAC, 1970) and Mg, as the aforementioned cation element in a content of the whole sintered body of 1 to 10 mass %, as calculated in oxides. These components are added mainly in the form of oxides and are contained mainly in the mode of oxides or composite oxides such as silicates in the sinter. A dense sintered body can hardly be produced, if the sintering agent is less than 1 mass %, and shortage of strength, toughness or heat resistance is invited whereas wear resistance drops for sliding parts, if more than 10 mass %. The content of the sintering agent may desirably be 2 to 8 mass %. In case a rare earth metal component is employed as the sintering agent, it is possible to use at least one of Sc, Y, La, Ce, Pr, Nd, Sm, Eu, Gd, Tb, Dy, Ho, Er, Tm, Yb or Lu. Of these, Tb, Dy, Ho, Er, Tm and/or Yb can be properly employed because they promote the crystallization of the intergranular phase and improve the high-temperature strength.

Next, the resistance heating element 10 is constructed to contain the aforementioned first conductive ceramic phase, e.g., the ceramic phase containing molybdenum disilicate ($MoSi_2$), tungsten carbide (WC) or tungsten disilicate ($SWi_2$) mainly, for example, in 50 to 75 mass %. In order to reduce the linear expansion coefficient difference from the insulating ceramic substrate 13 to enhance the thermal shock resistance, moreover, the insulating ceramic, as exemplified by the silicon nitride ceramic phase, to make up the main component of the insulating ceramic substrate 13 is contained in 40 to 50 mass %. Moreover, a sintering agent similar to that used in the insulating ceramic substrate 13 is contained in a range of 2 to 10 mass %.

Next, the ion current detecting electrode portion 14 is wholly constructed of the aforementioned second conductive ceramic phase, as mainly exemplified by the main silicon carbide phase containing silicon carbide as its main component. By the later-described method, specifically, the particular silicon carbide main phase has a structure which is bound by the intergranular phase based on the sintering agent similar to that of the resistance heating element 10.

In the present embodiment, the resistance heating element 10 is so arranged that its entirety is buried in the insulating ceramic substrate 13, and the ion current detecting electrode portion 14 is so protruded from the surface of the resistance heating element 10 or the surface of the leading end portion 10*a*, as shown in FIG. 2(*b*), that its leading end face is exposed as the ion current detecting face 15 to the surface or the leading end face of the insulating ceramic substrate 13. Moreover, the ion current detecting electrode portion 14 is so integrated with the resistance heating element 10 that its root end portion is buried in said resistance heating element 10.

Next, the outer cylinder 3 is soldered to the ceramic substrate 13, as shown in FIG. 2(*a*). In order to improve the wettability of the solder at the soldering time, a metallic thin film (although not shown) of nickel or the like is formed on the inner circumference of the outer cylinder 3 by a predetermined method (e.g., a plating or gas-phase filming method). To the rear end portion, moreover, there is similarly soldered a metallic terminal ring 20, to which the terminal end of a metallic lead portion is conducted. Moreover, the terminal end of the metallic lead portion 11 is conducted to the metallic stem 6. To the terminal ring 20, as shown in FIG. 1, there is bonded one end of the lead wire 21, the other end of which is bonded to a terminal fixture 24 arranged on the outer side of the metallic stem 6 through an insulating tube 22. With this construction, the electric power is fed from the not-shown power source through the metallic stem 6, the metallic lead portion 11, the resistance heating element 10, the metallic lead portion 12, the terminal ring 20, the lead wire 21 and the terminal fixture 24.

Figure 5:
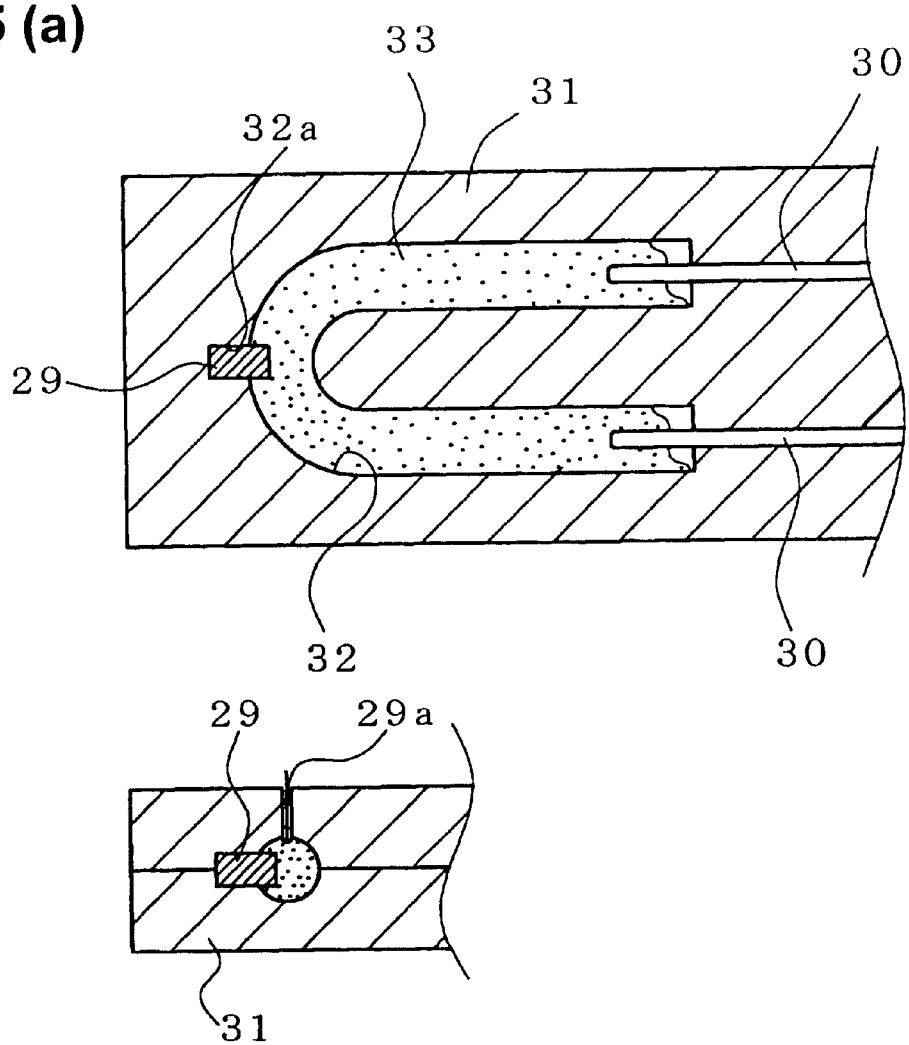
[FIG. 5] Explanatory views of steps of manufacturing the ceramic heater of FIG. 2.
Figure 5:
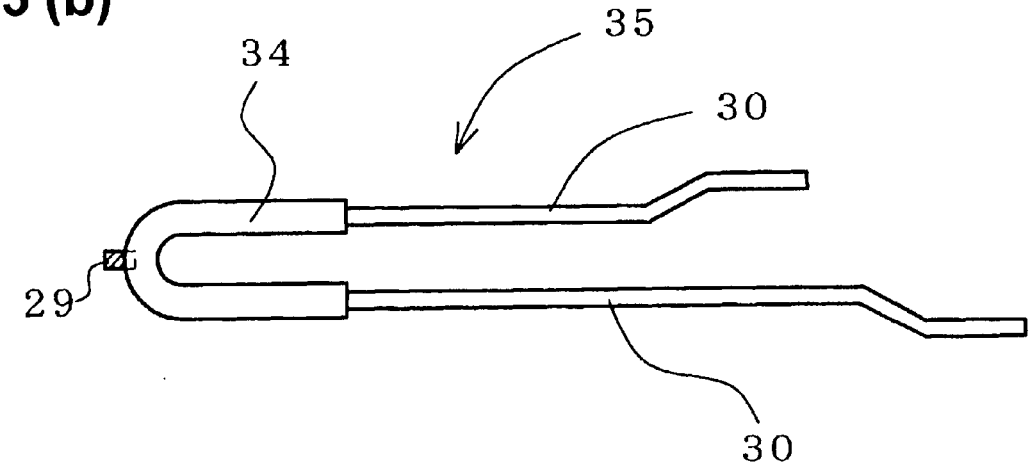

In the following will be described a method for manufacturing the ceramic heater 1. First of all, the second molding having a shape corresponding to the ion current detecting electrode portion is prepared as a shaped body (or molding) containing a material in the second conductive ceramic phase, such as a press molding or an injection molding of material powder containing silicon carbide powder and sinter assisting powder mainly. Into a mold (or die) 31 having a U-shaped cavity 32 corresponding to the resistance heating element 10, as shown in FIG. 5(*a*), there are so arranged electrode members 30 as inserts that their one-end portions enter said cavity 32. Moreover, a second molding 29 is so arranged that its root end portion enters the U-shaped bottom of the cavity 32. In this state, moreover, a compound 33, which contains first conductive ceramic phase material powder (e.g., powder of molybdenum disilicate, tungsten carbide or tungsten disilicate), silicon nitride powder and sintering agent powder, and a binder (an organic binding agent), is injected through a compound feed port 29*a* into the cavity 32, by the so-called "insert molding method" to prepare an integral molding 35, in which a first molding 34 for the U-shaped resistance heating element, the second molding 29 for the ion current detecting electrode portion, and the electrode members 30 are integrated, as shown in FIG. 5(*b*). In this case, the entirety of the electrode forming portion is formed of the second molding 29, and the general entirety (excepting the buried portion of the second molding 29) of the heating element molding portion is formed by the first molding 34.

Figure 6:
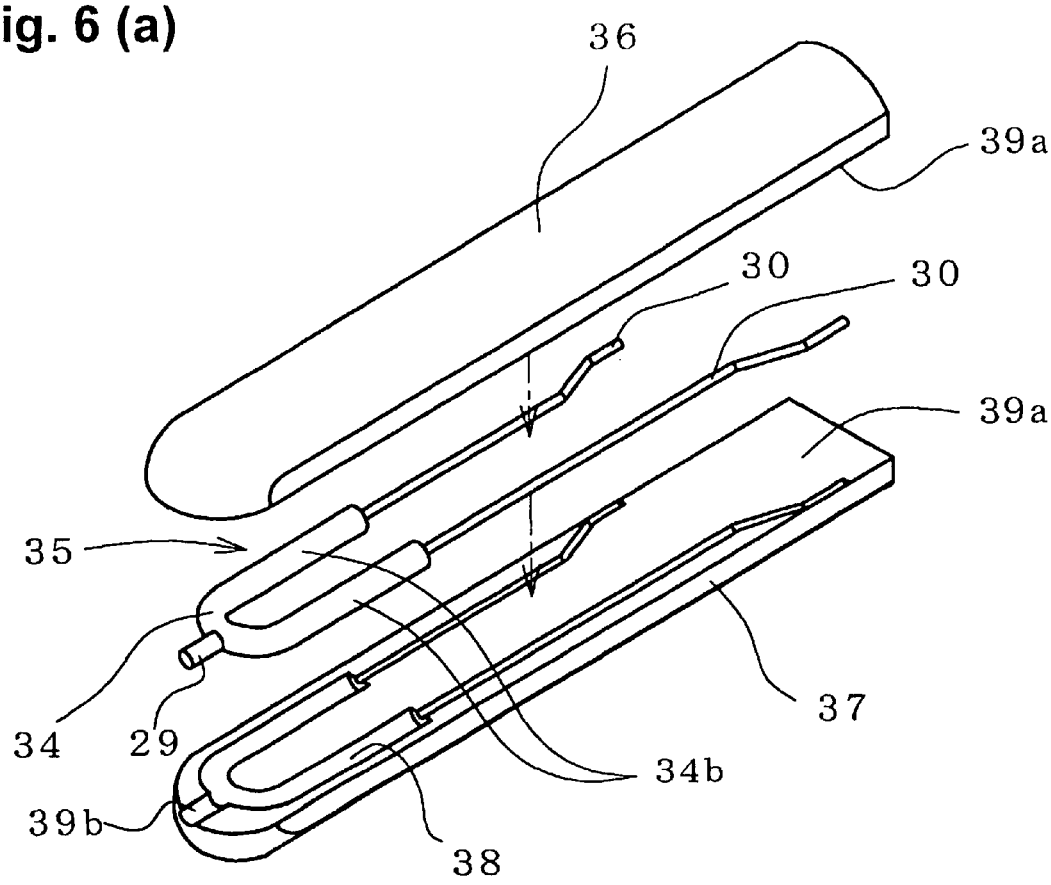
[FIG. 6] Explanatory views of steps subsequent to FIG. 5.
Figure 6:
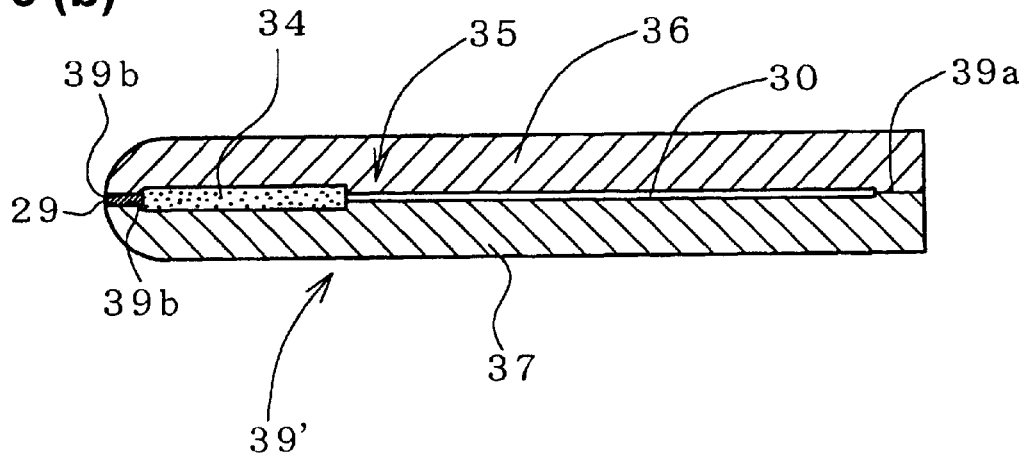
Figure 7:
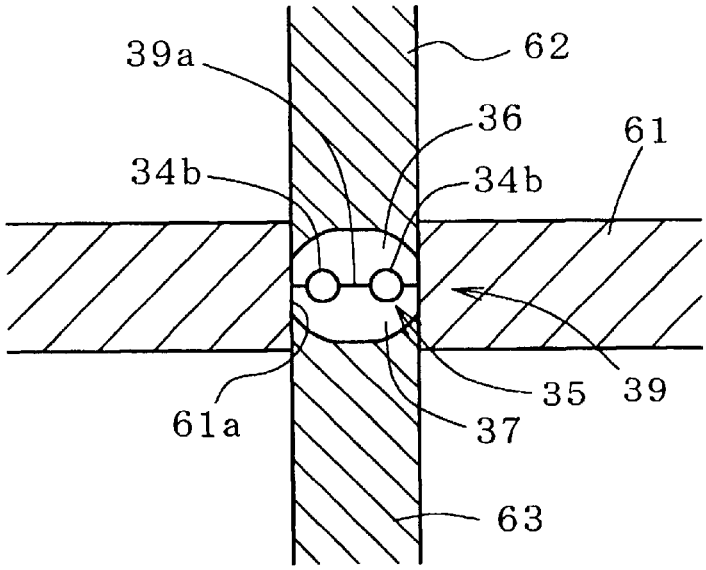
[FIG. 7] Explanatory views of steps subsequent to FIG. 6.
Figure 7:
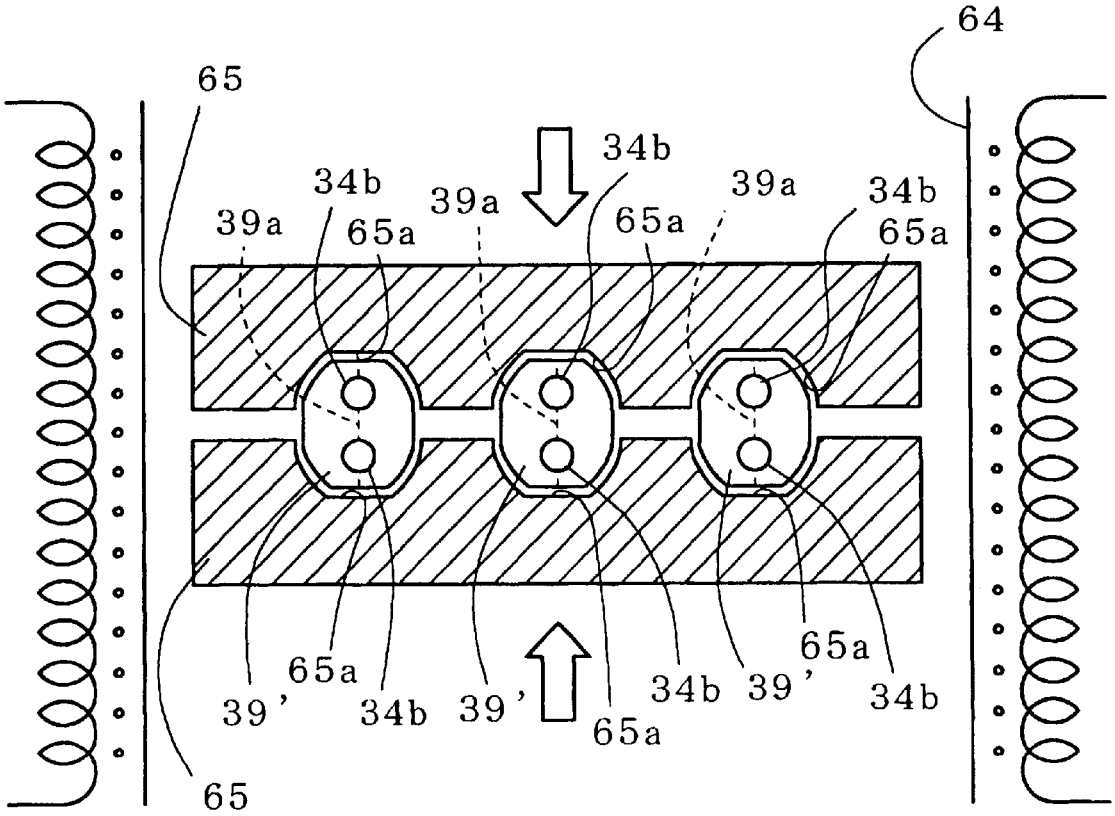

By press-molding a material powder for forming the ceramic substrate 13 separately, on the other hand, there are prepared separate preparatory moldings 36 and 37 which are vertically separate, as shown in FIG. 6(*a*). In mating faces 39*a* of these separate preparatory moldings 36 and 37, there is a recess 38 or 39*b* which is shaped to correspond to the integral molding 35. Next, the integral molding 35 is fitted in that recess 38, and the separate preparatory moldings 36 and 37 are registered/mated on said mating faces 39*a*. As shown in FIG. 7(*a*), moreover, those separate preparatory moldings 36 and 37 and integral molding 35 are fitted in the cavity 61*a* of a mold 61 and are pressed/compressed by using punches 62 and 63 to form their integrated composite molding 39, as shown in FIG. 6(*b*). Here, the pressing direction is set substantially normal to the mating faces 39*a* of the separate preparatory moldings 36 and 37, as shown in FIG. 7(*a*).

The composite molding 39 thus obtained is calcined at first at a predetermined temperature (e.g., about 600° C.) for removing the binder component or the like in the material powder, to prepare a calcined body 39', as shown in FIG. 6(*b*) (Here, the calcined body will be deemed as a "composite molding" in a broad sense). Subsequently, the calcined body 39' is set in cavities 65*a* and 65*a* of hot pressing molds 65 and 65 made of graphite or the like.

Figure 8:
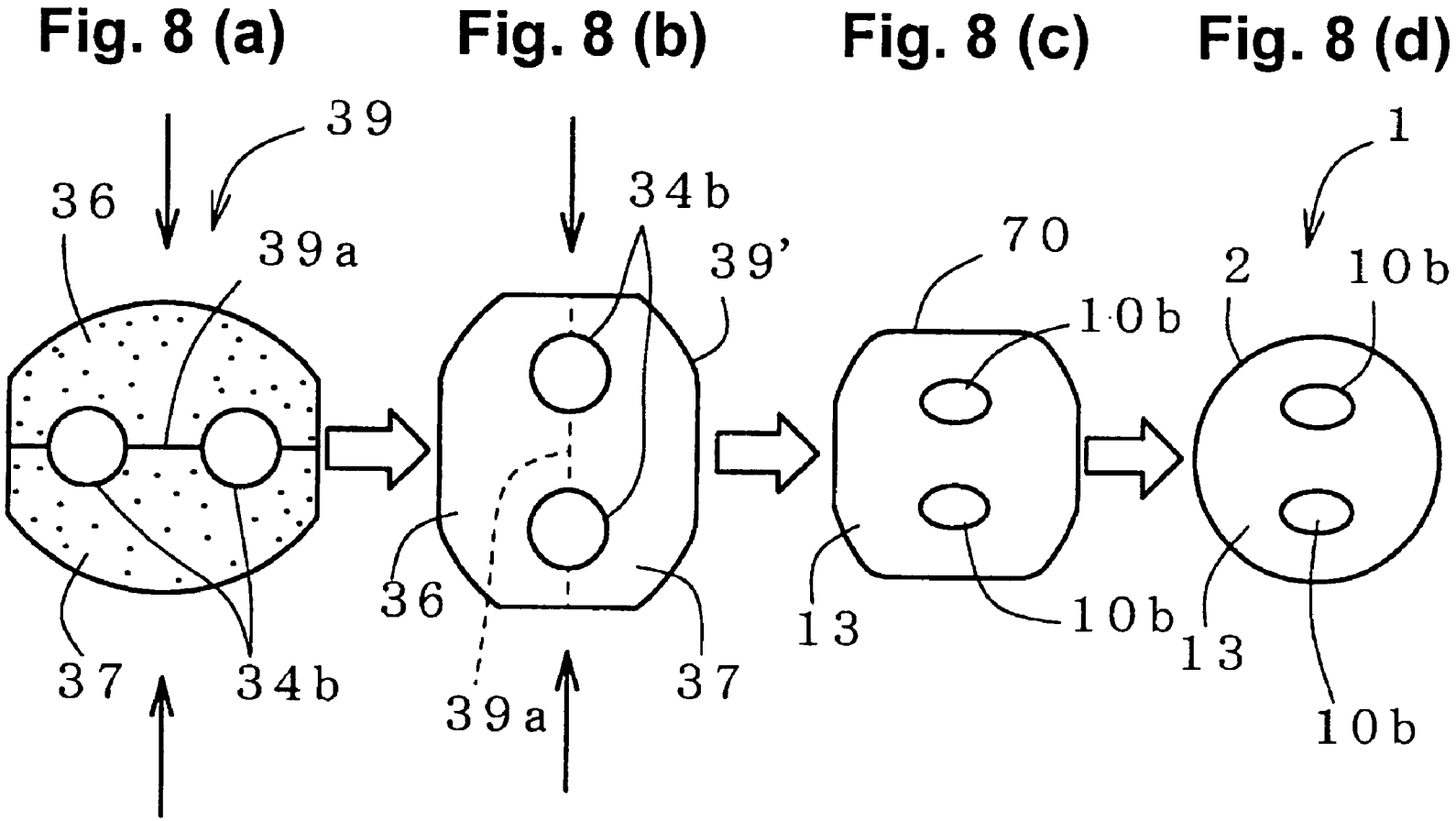
[FIG. 8] Schematic views showing changes in the sectional shapes of a composite molding and a sinter.
Figure 9:
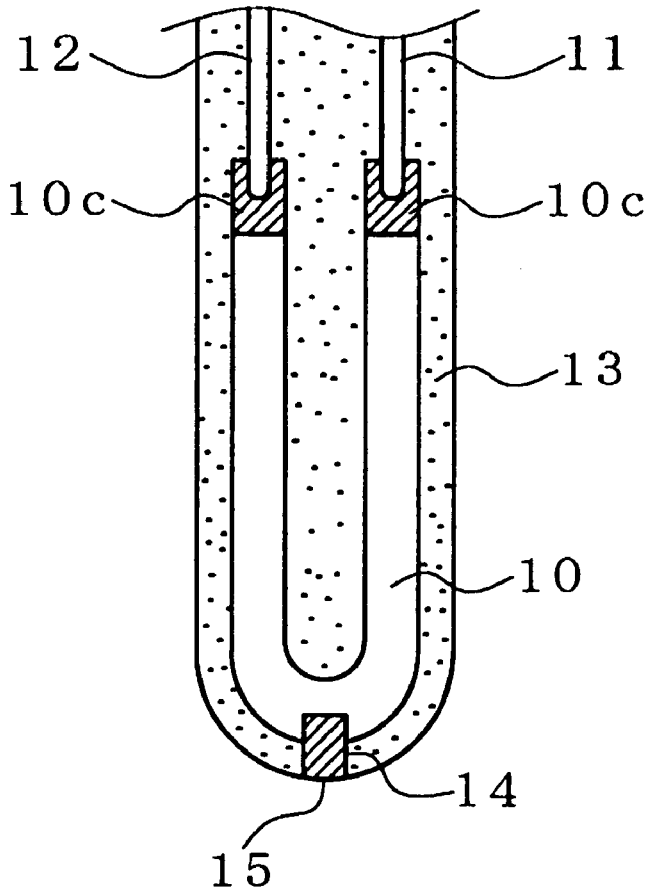
[FIG. 9] A sectional view of an essential portion showing a first modification of the ceramic heater of the invention.

The calcined body 39' thus set in the molds 65 is sintered, as shown in FIG. 7(*b*), in a sintering furnace 64 (as will be simply called the "furnace 64") at a sinter holding temperature (1,700° C. or higher, as exemplified by about 1,800° C.) and in an atmosphere while being pressed between the two molds 65 and 65, to prepare a sintered product 70, as shown in FIG. 8(*c*). At this time: the first molding 34 shown in FIG. 6(*b*), the second molding 29 and the separate preparatory moldings 36 and 37 form the resistance heating element 10, the ion current detecting electrode portion 14 and the ceramic substrate 13, respectively. Moreover, the individual electrode members 30 become the metallic lead portions 11 and 12.

By the sintering thus far described, the calcined body 39' of FIG. 7(*b*) becomes the sintered product 70 of FIG. 8(*c*) while being compressed in the direction along the mating faces 39*a* of the separate preparatory moldings 36 and 37. At this time, straight portions 34*b* of the resistance heating element molding 34 of FIG. 8(*b*) are deformed while the circular section being crushed in said compressed direction, to form the straight portions 10*b* of the resistance heating element 10 having an elliptical cross-section.

Figure 4:
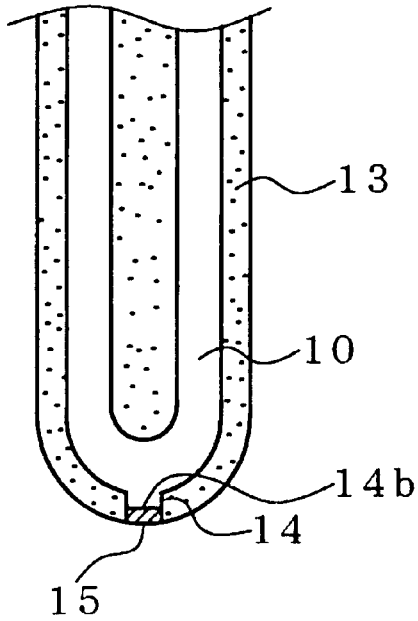
[FIG. 4] A sectional view showing a modification of the mode of forming an ion current detecting electrode portion.

Here, only the surface layer portion of the ion current detecting electrode portion 14 containing the ion current detecting face 15 may be formed into a formed portion 14*b* made mainly of the second conductive ceramic phase, as shown in FIG. 4. In this case, the remaining portion of the ion current detecting electrode portion 14 may be made of the same material as that of the resistance heating element 10. This structure can be made at absolutely the same step as the aforementioned one excepting that an injection molding is similarly done by arranging a short second molding for the formed portion 14*b* at the leading end in an accommodating portion 32*a* of the mold 33. And, the electrode forming portion has a shape formed by the second molding, only at its leading end portion.

Moreover, the connection portions with the metallic lead portions 11 and 12 can be formed into formed portions 10*c* and 10*c* made mainly of the second conductive ceramic phase. In this case, the moldings to become the formed portions 10*c* and 10*c* may be integrated in advance with the metallic lead portions 11 and 12 so that the insert molding step for forming the first molding to become the resistance heating element 10 may be performed by using the integrated moldings as inserts.

The sintered product 70 of FIG. 8(*c*) thus obtained is subjected on its outer circumference to a working or polishing treatment so that the ceramic substrate 13 is circle-shaped in its section into the final ceramic heater as shown FIG. 8(*d*). The glow plug 50 shown in FIG. 1 is completed when the ceramic heater 1 is assembled with the necessary parts such as the main fixture 4.

Here will be described a manner for using the glow plug 50.

Figure 16:
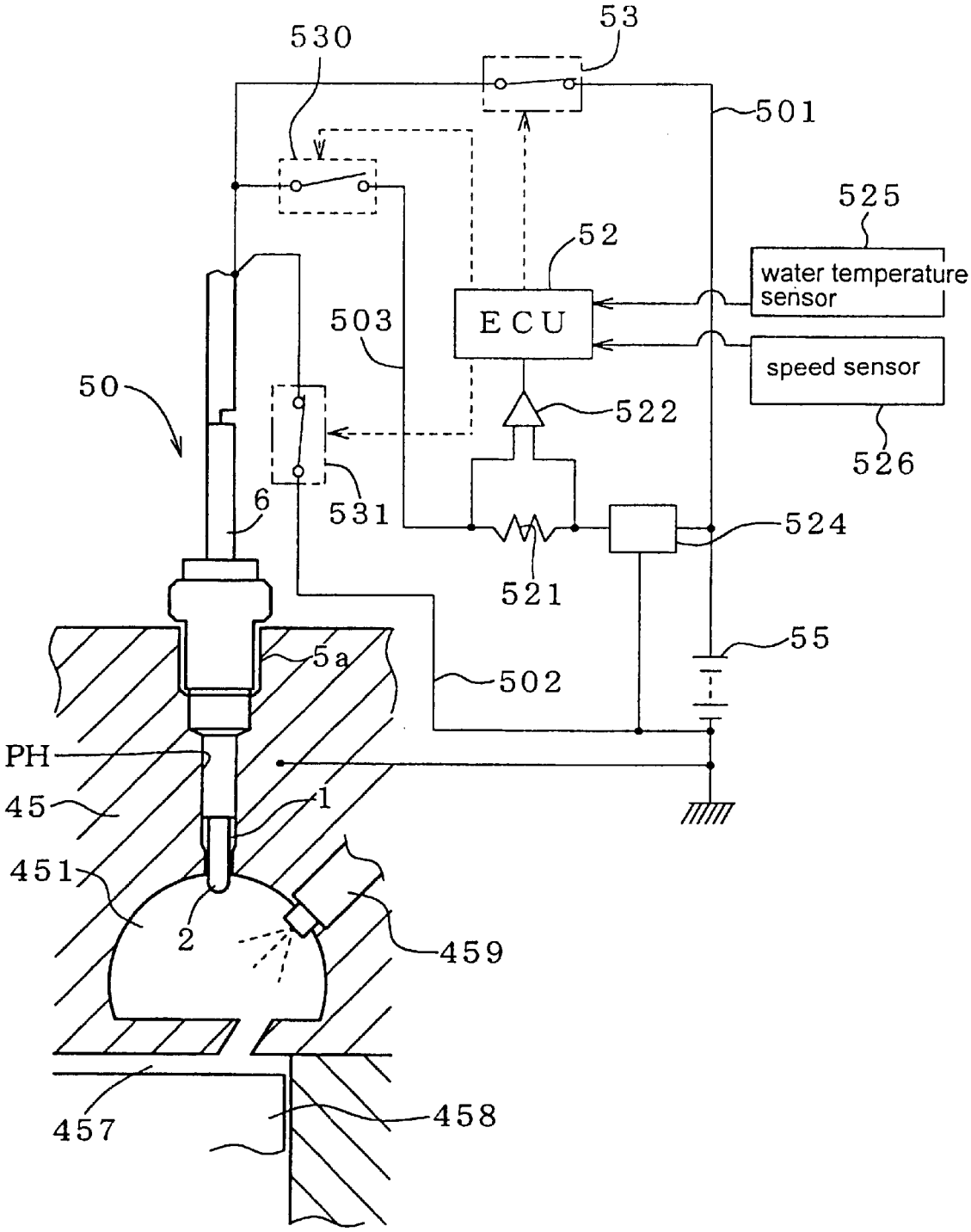
[FIG. 16] A circuit diagram showing one example of the electric construction of an ion current measuring device using the glow plug of FIG. 1.

As shown in FIG. 16, the glow plug 50 is attached at its threaded portion 5*a* to an engine block 45 of a Diesel engine. At this time, the heating portion 2 of the ceramic heater 1 is positioned in a swirl chamber 451 (which is conceptionally identical to that disclosed in Japanese Patent Kokai Publication No. JP-10-89686A but construed to form a part of the combustion chamber in a broad sense in this specification) communicating with a combustion chamber 457.

FIG. 16 shows one example of an electric construction of an ion current detecting device using the glow plug 50. In this device, the ceramic heater 1 has its one terminal (on the side of the metallic stem 6) connected with a power side wiring portion 501 and its other terminal (on the side of the metallic housing 4) connected with a ground side wiring portion 502. Here, the individual wiring portions 501 and 502 are provided with switch portions 53 and 531 for switching ON/OFF the conduction passages formed thereby, individually. Either of these switch portions 53 and 531 is constructed of a relay, a power transistor as a contactless switch portion, an IGBT (Insulated Gate Bipolar Transistor) or a thyristor, which is activated in response to a control signal from an ECU (Engine Controlling Unit constructed mainly of a CPU) 52 to function as an engine control unit and an ion current detecting unit.

On the other hand, an ion current measuring wiring portion 503 is provided in a form to bypass the switch portion 53 of the power side wiring portion 501. Said wiring portion 503 is provided thereon with a current detecting resistor 521 and a switch portion 530 for switching ON/OFF the conduction passage formed by said wiring portion. The switch portion 530 is constructed of either a relay or a C-MOS type bidirectional analog switch IC circuit as a contactless switch portion, which is activated in response to a control signal from the ECU 52. Moreover, the difference between the two terminal voltages of the current detecting resistor 521 is amplified by a differential amplifier 522 and is input as an ion current detecting signal to the ECU 52. Here, numeral 55 designates a battery which is mounted on the vehicle for acting as a heating power source unit. Moreover, numeral 524 designates an ion generating power source unit for generating an ion generating current on the basis of said battery voltage. Moreover the switch portions 53, 530 and 531 function as power switching portions. To the ECU 52, moreover, there are input the individual detection signals of a water temperature sensor 525 for monitoring the temperature of the engine cooling water, and a speed sensor 526 for monitoring the engine speed.

At the time of starting the engine, the heater 1 is connected with the heating battery 55 so that it is energized to warm up the inside of the swirl chamber 451. At this time, the ECU 52 turns ON the switch portions 53 and 531 to connect the power side wiring portion 501 and the earth side wiring portion 502 directly and turns OFF the switch portion 530 to feed no electric current to the ion current detecting wiring portion 503. When the cooing water temperature by the water temperature sensor 525 reaches the warm-up temperature, moreover, the switch portions 53 and 531 are turned OFF, but the switch portion 530 is turned ON to switch the power source and the conduction passages for the ion current generation. As a result, the ion voltage is applied by the ion generating power source 524 between the inner face of the swirl chamber 451 in the grounded engine block and the ion current detecting electrode portion 14 (FIG. 2) mounted in the ceramic heater 1, so that the ion discharge current is produced.

When the combustion gas flows in this state into the swirl chamber 451, the ion discharge current fluctuates so that the ion current waveform reflecting the burning state is established in the ion current detecting wiring portion 503. This waveform is detected at the current detecting resistor 521 through the differential amplifier 522 by the ECU 52. For example, this ECU 52 monitors the cooling water temperature or the engine speed with the water temperature sensor 525 or the speed sensor 526. When the water temperature is excessively low or when the engine speed is excessively low, the ECU 52 judges that the warm-up is insufficient, and turns OFF the switch portion 530 and ON the switch portions 53 and 531 again so that the heater 1 may generate the heat for a certain (or constant) time period to preheat for the warm-up.

According to the invention, the second conductive ceramic phase constructing the ion current detecting electrode portion 14 of the ceramic heater 1 is constructed mainly of such a ceramic component, e.g., silicon carbide as is superior in the oxidation resistance to the first conductive ceramic phase constructing the resistance heating element 10. Even if the ion current detecting face 15 is repeatedly exposed to the hot combustion gas, therefore, the electrode 14 is hardly oxidized or worn so that it can have a long lifetime.

Here will be described a modification of the ceramic heater of the invention together with its manufacturing method.

Figure 10:
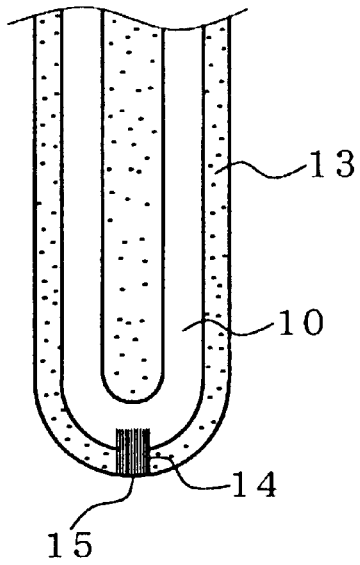
[FIG. 10] A sectional view of an essential portion showing a second modification of the same.

First of all, the second conductive ceramic phase making up the ion current detecting electrode portion 14 can be formed fibrous. This fibrous second conductive ceramic phase can be constructed mainly of silicon carbide, for example. This construction can be made at a similar step by making the second molding 29 as an insert of silicon carbide fibers at the injection molding time shown in FIG. 5, for example. If, in this case, the fibers are bundled and cut to a predetermined length so that they may be arranged with their longitudinal direction being aligned with the protruding direction of the second molding 29 and the ion current detecting electrode portion 14 formed, the ion current detecting electrode portion 14 obtained can be hardly deformed to reduce the failure. In the ceramic heater obtained in this case, as shown in FIG. 10, the second conductive ceramic phase constructing the ion current detecting electrode portion 14 is formed into the fibrous shape in which it is oriented in the protruding direction of said ion current detecting electrode portion 14. This shape is desired for improving the electric conduction in the protruding direction of the ion current detecting electrode portion 14, that is, from the ion current detecting face 15 to the resistance heating element 10.

Figure 11:
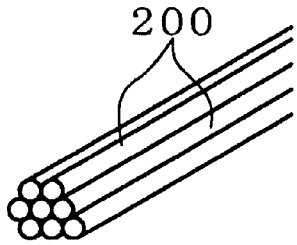
[FIG. 11] Perspective views schematically showing several appearances of silicon carbide fibers shown in the modification of FIG. 10.
Figure 11:
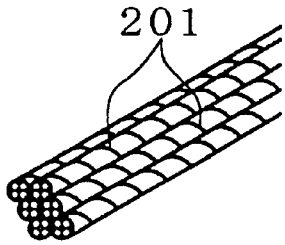

Meanwhile, the silicon carbide fibers to be employed at said step may be either by bundling single yarns, as shown FIG. 11(*a*), or by bundling one or plural twisted filaments, as shown in FIG. 11(*b*). The latter carbon fibers are commercially available as Nicalon (under Trade Name) of Nippon Carbon Kabushiki Gaisha. Especially in case where the electric conductivity is to be preferred as the electrodes, it is desirable to adopt NL-501 (product name) of low resistance yarns. In the case of NL-501, the single filament has a diameter of about 14 microns, and the twisted yarn has about 500 single filaments and a specific electric resistance of 0.5 to 5.0 ohms·cm.

Figure 13:
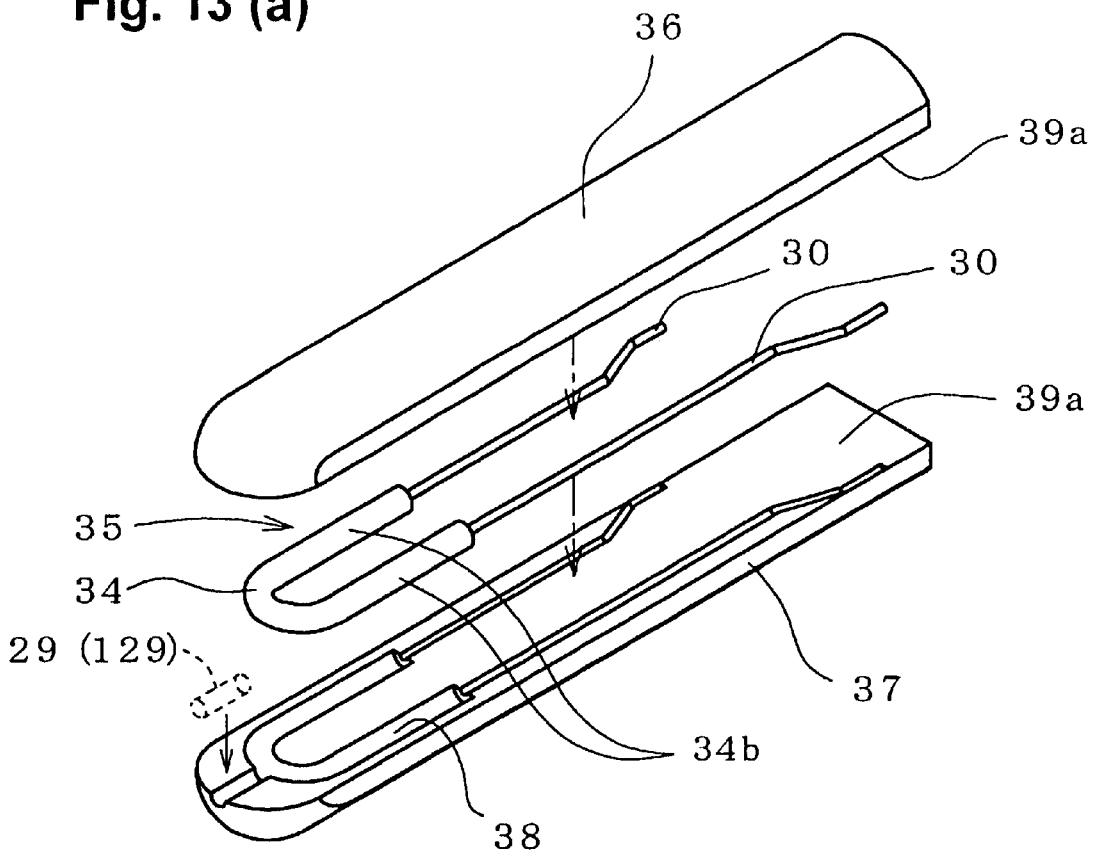
[FIG. 13] Step explaining diagrams showing another embodiment of the method for manufacturing the ceramic heater of FIG. 10.
Figure 13:
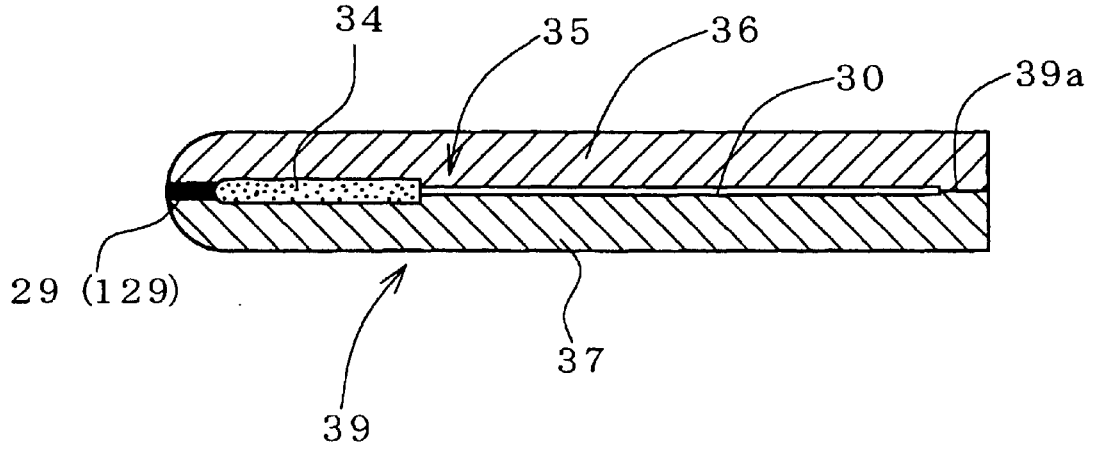
Figure 14:
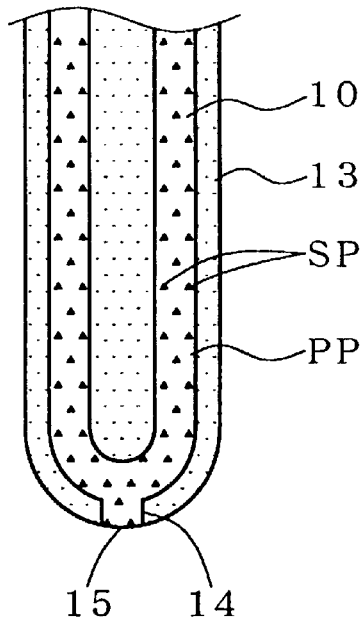
[FIG. 14] A schematic section of an essential portion showing a third modification of the ceramic heater of the invention.

The ion current detecting electrode portion 14 thus constructed need not be made by integrating the second molding 29 of silicon carbide fibers with the first molding 34 at the injection molding time, as shown in FIG. 5. At the time of forming the integral molding 39, however, there can be adopted a method, by which the second molding 29 separate of the first molding 34 is sandwiched between the separate preparatory moldings 36 and 37 and is sintered, as shown in FIG. 13.

Figure 12:
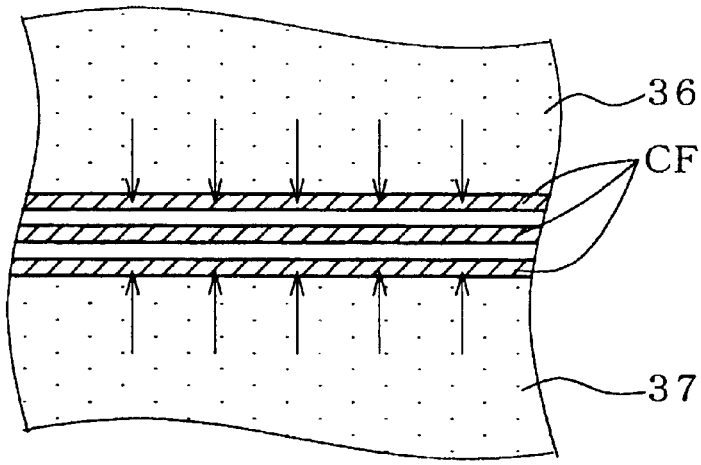
[FIG. 12] Diagrams schematically showing a manufacture method for converting carbon fibers being sintered into silicon carbide.
Figure 12:
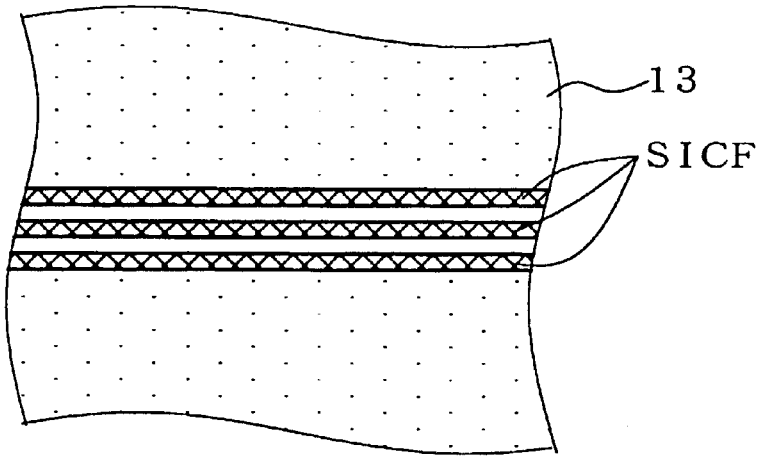

Moreover, the method for constructing the second conductive ceramic phase mainly of silicon carbide need not use a material of silicon carbide from the first time but can adopt a kind of reactive sintering method, by which a carbonaceous material containing carbon mainly and a silicon component source material are in contact with a portion to form the second conductive ceramic phase in the composite molding so that the carbonaceous material and the silicon component source material are caused to react at the sintering time to produce the silicon carbide. In case the second conductive ceramic phase composed mainly of the silicon carbide is to be formed into the fibrous state, for example, a second molding 129 made similarly of carbon fibers may be used in place of the second molding 29 of silicon carbide fibers with reference to FIG. 13. In this case, the silicon nitride powder (or the silicon nitride material) constructing the separate preparatory moldings 36 and 37 (or the substrate moldings) is the silicon component source material. By the sintering, the silicon component from the separate preparatory moldings 36 and 37 is caused to diffuse into carbon fibers CF, as shown in FIG. 12(*a*), and to be formed into silicon carbide fibers SICF, as shown in FIG. 12(*b*).

Figure 15:
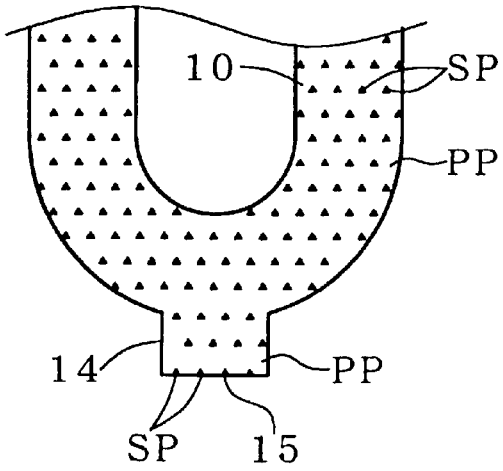
[FIG. 15] Schematic sections showing essential portion of other several modifications.
Figure 15:
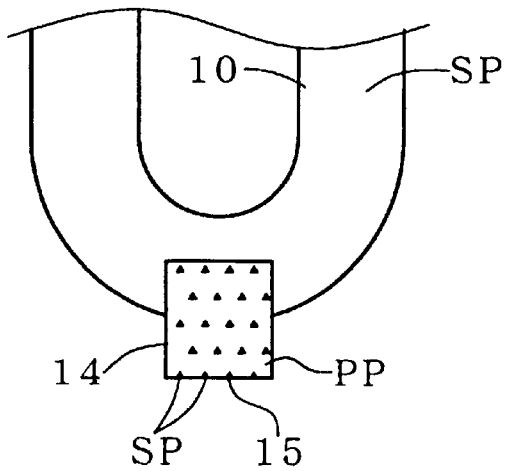

Next, the ion current detecting electrode portion 14 can be constructed of a composite conductive ceramic in which at least a first conductive ceramic phase PP and a second conductive ceramic phase SP coexist as shown in FIG. 15(*a*). In this case, the second conductive ceramic phase SP exposed to the ion current detecting face 15 contributes to an improvement in oxidation resistance or wear resistance of the ion current detecting electrode portion 14. Moreover, the first conductive ceramic phase PP partially coexists so that the electric conductivity of the entire ion current detecting electrode portion 14 is improved to provide an advantage that the detection accuracy of the ion current can be improved. This structure may be obtained by forming the electrode forming portion for the ion current detecting electrode portion 14 of a composite material which contains at least a material (e.g., powder) of the first conductive ceramic phase PP and a material (e.g., powder) of the second conductive ceramic phase SP.

As shown in FIG. 15(*b*), for example, the resistance heating element 10 can be constructed mainly of the first conductive ceramic phase PP, and only the ion current detecting electrode portion 14 can be constructed of the composite conductive ceramic in which the first conductive ceramic phase PP and the second conductive ceramic phase SP coexist. This structure can be made by an absolutely similar method if the second molding 29 has been constructed of a molding of said composite material, for example, in FIG. 5.

If the resistance heating element 10 can keep the electric characteristics satisfactory, on the other hand, the ion current detecting electrode portion 14 and the resistance heating element 10 can be wholly made of the composite conductive ceramic, as shown in FIG. 15(*a*). Then, the insert molding is not needed any more, but there can be adopted the method by which the ion current detecting electrode portion 14 and the resistance heating element 10 are formed together by injection-molding said composite material, so that the manufacture process can be drastically simplified to lower the manufacturing cost.

EXPERIMENTAL EXAMPLES

The material powder for a ceramic substrate was prepared, as follows. Specifically, $Si_3N_4$ powder having an average grain diameter of 1 micron was blended with a sintering agent powder of $Er_2O_3$ (of 8 mass %), $V_2O_5$ (of 1 mass %), $WO_3$ (of 2 mass %) and $MoSi_2$ (of 3.5 mass %) in the individual parenthesized weight contents, and the resultant mixture was wet-pulverized with a bowl mill. After a predetermined amount of binder was added, the pulverized mixture was dried by a spray drying method to prepare a material powder for the ceramic substrate. On the other hand, the material powder for a resistance heating element was prepared, as follows. First of all, as the various kinds of conductive ceramic powder, 55 mass % of tungsten carbide powder having an average grain diameter of about 0.5 microns, the remainder being silicon nitride ($Si_3N_4$) powder (40.05 mass %), and $Er_2O_3$ (3.6 mass %), $V_2O_5$ (0.45 mass %) and $WO_3$ (0.9 mass %) as a sintering agent powder were blended to satisfy the individual parenthesized weight contents and were wet-mixed with a solvent for 50 hours with a bowl mill and dried. After this, polypropylene and wax were added as an organic binder to prepare a compound followed by pelletizing.

As a material for the ion current detecting electrode portion, moreover a bundle of, about 250 silicon carbide fibers (of the aforementioned NICALON: NL-501) cut to a length of 5 mm were used and injection-molded with said pellets, as shown in FIG. 5(*a*), to prepare an integral molding 35, as shown in FIG. 5(*b*).

Next, the separate preparatory moldings 36 and 37, as shown in FIG. 6(*a*), were formed by the aforementioned method using said material powder and were press-molded integrally with said integral molding 35 by the aforementioned method, to form a composite molding 39, as shown in FIG. 6(*b*) or FIG. 7(*a*). This composite molding 39 was calcined at about 800° C. in a nitrogen gas into the calcined body 39', as shown in FIG. 37 7(*b*), and this calcined body 39' was hot-press sintered. Here, the sintering was done by setting the sintering temperature at 1,700 to 2,000° C., the pressing pressure at 150 to 300 Kgf/cm$^2$ and the sinter-retaining time at 60 to 120 minutes, whereas the sintering atmosphere was a nitrogen gas atmosphere having a purity of 99.99% and a pressure of 50 Pa (No. 1).

Moreover, the following test samples were manufactured as comparison examples:

(No. 2) The ion current detecting electrode portion was injection-molded by using the same granulated pellets as those of the resistance heating element and was then sintered like No. 1.

(No. 3) In the sinter of No. 2, an applied layer of platinum paste was formed on the leading end face of the ion current detecting electrode portion and was sintered in an inert atmosphere at 950° C. to form a Pt protective layer.

(No. 4) In No. 2, MoSi2 powder was substituted for the WC powder.

(No. 5) The ion current detecting electrode portion was constructed of metallic tungsten in place of the silicon carbide fibers.

The voltage was so adjusted that the highest temperature of the substrate surface might reach 1,450° C. (for the acceleration test), and cycles of the ON time of 1 minute and the OFF time of 1 minute (for forced cooling with air) were repeated. It was confirmed every 50 cycles till 500 cycles and every 500 cycles after the 500 cycles by observations using an optical microscope or by a fluorescent flaw detecting method whether or not fault such as breakage had occurred at or near the ion current detecting electrode portion. At the instant when the fault was recognized, the test was ended. The results thus far described are enumerated in Table 1.

TABLE 1

| No. | Material for Ion Current Detecting Electrode | Result (at cycles) | Contents of Fault |
|---|---|---|---|
| 1 | SiC | No Fault in 20,000 | — |
| 2* | WC + $Si_3N4$ | Fault in 100 | Cracks around Ion Current Detecting Face by Oxidation of WC |
| 3* | WC + $Si_3N_4$ + Pt Covered Layer | Fault in 12,000 | Separation at Pt Covered Film |
| 4* | $MoSi_2$ + $Si_3N_4$ | Fault in 500 | Cracks at Ion Current Detecting Electrode Portion |
| 5* | W | Fault in 100 | Cracks around Ion Current Detecting Face by Oxidation of W |

Symbol * indicates outsides the Invention.

According to these results, it is found that the ceramic heater of the embodiment, in which the ion current detecting electrode portion was constructed of the silicon carbide fibers, had no fault even in the test up to 20,000 cycles, and that the ceramic heaters of the comparison examples had faults such as cracks sooner or later.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A ceramic heater comprising:

an insulating ceramic substrate;

a resistance heating element made mainly of conductive ceramic and buried in said insulating ceramic substrate; and an ion current detecting electrode portion made mainly of conductive ceramic and integral with said resistance heating element in said insulating ceramic substrate and having a portion of its own surface exposed as an ion current detecting face to the surface of said insulating ceramic substrate, wherein said ion current detecting electrode portion is constructed such that a portion including at least a portion of said ion current detecting face is made of a nonmetallic conductive ceramic having a cation component of at least one nonmetallic element.

2. A ceramic heater as set forth in claim 1, wherein said resistance heating element is made mainly of a first conductive ceramic phase having a cation component of a metallic element, and wherein said ion current detecting electrode portion is constructed such that the portion including at least a portion of said ion current detecting face is made of a second conductive ceramic phase made of said nonmetallic conductive ceramic.

3. A ceramic heater as set forth in claim 1, wherein said nonmetallic conductive ceramic is composed mainly of silicon carbide.

4. A ceramic heater comprising:

an insulating ceramic substrate;

a resistance heating element made mainly of conductive ceramic and buried in said insulating ceramic substrate; and an ion current detecting electrode portion made mainly of conductive ceramic and integral with said resistance heating element in said insulating ceramic substrate and having a portion of its own surface exposed as an ion current detecting face to the surface of said insulating ceramic substrate, wherein said resistance heating element is made mainly of a first conductive ceramic phase;

said ion current detecting electrode portion being constructed such that a portion including at least a portion of said ion current detecting face is made of a second conductive ceramic phase having a better oxidation resistance than that of said first conductive ceramic phase.

5. A ceramic heater as set forth in claim 4, wherein said second conductive ceramic phase is made mainly of one kind or two kinds or more selected from the group consisting of silicon carbide, titanium nitride, zirconium nitride, hafnium nitride, titanium boride, zirconium boride, and hafnium boride.

6. A ceramic heater as set forth in claim 2 or 4, wherein said first conductive ceramic phase is made mainly one kind or two kinds or more selected from the group consisting of molybdenum disilicide, tungsten carbide, tungsten disilicide, pentamolybdenum trisilicide, and molybdenum silicon carbide.

7. A ceramic heater as set forth in claim 1 or 4, wherein said insulating ceramic substrate is made mainly of silicon nitride.

8. A ceramic heater as set forth in claim 1 or 4, wherein said second conductive ceramic phase is formed in a fibrous configuration.

9. A ceramic heater as set forth in claim 1 or 4, wherein said resistance heating element is so arranged that its entirety is buried in said insulating ceramic substrate, and wherein said ion current detecting electrode portion is so protruded from the surface of said resistance heating element that its leading end face is exposed as said ion current detecting face to the surface of said insulating ceramic substrate.

10. A ceramic heater as set forth in claim 4, wherein said resistance heating element is made mainly of said first conductive ceramic phase.

11. A ceramic heater as set forth in claim 9, wherein said ion current detecting electrode portion is made in its entirety mainly of said second conductive ceramic phase.

12. A ceramic heater as set forth in claim 1 or 4, wherein said ion current detecting electrode portion is made of at least a composite conductive ceramic in which said first conductive ceramic phase and said second conductive ceramic phase coexist.

13. A ceramic heater as set forth in claim 12, wherein said ion current detecting electrode portion and said resistance heating element are wholly made of said composite conductive ceramic.

14. A ceramic heater as set forth in claim 9, wherein said second conductive ceramic phase constructing said ion current detecting electrode portion is formed in a fibrous configuration being oriented in the protruded direction of said ion current detecting electrode portion.

15. A ceramic heater as set forth in claim 14, wherein said second conductive ceramic phase is made mainly of silicon carbide and in the fibrous configuration.

16. A method for manufacturing a ceramic heater comprising:

an insulating ceramic substrate;

a resistance heating element made mainly of conductive ceramic and buried in said insulating ceramic substrate; and an ion current detecting electrode portion made mainly of conductive ceramic and integral with said resistance heating element in said insulating ceramic substrate and having a portion of its own surface exposed as an ion current detecting face to the surface of said insulating ceramic substrate;

said method comprising:

preparing a composite shaped body, in which an electrode shaped portion for said ion current detecting electrode portion and a heating element shaped portion for said resistance heating element are buried in a substrate shaped portion for said insulating ceramic substrate;

sintering said composite shaped body; and forming said ion current detecting electrode portion such that a portion including at least a portion of said ion current detecting face is made of a nonmetallic conductive ceramic having a cation component of at least one nonmetallic element.

17. A method for manufacturing a ceramic heater as set forth in claim 16, further comprising:

forming a portion of said electrode shaped portion for said ion current detecting face, into a second shaped body containing a material for at least said second conductive ceramic phase;

forming an integrated shaped body in which said second shaped body and a first shaped body made mainly of a material for said first conductive ceramic phase and including a portion for said heating element shaped portion are integrated to provide an integrated shaped body; and burying said integrated shaped body in said substrate shaped portion for said insulating ceramic substrate, to form said composite shaped body.

18. A method for manufacturing a ceramic heater as set forth in claim 17, wherein said integrated shaped body is formed by an insert molding method, by which said second shaped body is arranged as an insert in a mold so that a compound containing a material for said first shaped body may be injected into said mold.

19. A method for manufacturing a ceramic heater as set forth in claim 16, wherein said heating element shaped portion is made of silicon carbide fibers.

20. A method for manufacturing a ceramic heater as set forth in claim 16, wherein at least said electrode shaped portion is made of a composite material containing a material of said first conductive ceramic phase and a material of said second conductive ceramic phase.

21. A method for manufacturing a ceramic heater as set forth in claim 20, wherein said composite material is a compound, and wherein said electrode shaped portion and said heating element shaped portion are formed as an integral injection molding made of said composite material.

22. A method for manufacturing a ceramic heater as set forth in claim 16, wherein in order to make said second conductive ceramic phase mainly of silicon carbide, there is established a state in which a carbonaceous material made mainly of carbon and a silicon component source material are brought into a contact state at a site to form said second conductive ceramic phase in said composite shaped body, and wherein said carbonaceous material and said silicon component source material are caused during said sintering time to react to produce silicon carbide.

23. A method for manufacturing a ceramic heater as set forth in claim 22, wherein carbon fibers are used as said carbonaceous material.

24. A method for manufacturing a ceramic heater as set forth in claim 22, wherein said silicon component source material is a silicon nitride material for constructing said substrate shaped portion.

25. A glow plug characterized by comprising:

a ceramic heater as set forth in claim 1 or 4; and a housing having a mounting portion formed for holding said ceramic heater and for mounting said ceramic heater in an internal combustion engine so that said ion current detecting face may be positioned in a combustion chamber.

26. An ion current detecting device characterized by comprising:

a glow plug as set forth in claim 25;

a heating power source unit for energizing said resistance heating element of said glow plug to heat;

an ion generating power source unit for applying an ion generating voltage to said ion current detecting electrode portion through said resistance heating element of said glow plug;

a power switching portion for switching to connect one of said heating power source unit and said ion generating power source unit selectively with said glow plug; and an ion current detecting portion for detecting an ion current to flow to said ion current detecting electrode portion.

* * * * *